US009414167B2

(12) United States Patent
Rostami

(10) Patent No.: US 9,414,167 B2
(45) Date of Patent: Aug. 9, 2016

(54) USER ADORNABLE APPARATUS AND SYSTEM FOR GENERATING USER DETECTABLE AUDIO AND MECHANICAL VIBRATION SIGNALS

(75) Inventor: Ramin Rostami, Calabasas, CA (US)

(73) Assignee: ADVANCED WIRELESS INNOVATIONS LLC, Santa Monica, CA (US)

( * ) Notice: Subject to any disclaimer, the term of this patent is extended or adjusted under 35 U.S.C. 154(b) by 430 days.

(21) Appl. No.: 12/642,759

(22) Filed: Dec. 18, 2009

(65) Prior Publication Data

US 2010/0278359 A1 Nov. 4, 2010

Related U.S. Application Data

(60) Provisional application No. 61/174,484, filed on Apr. 30, 2009.

(51) Int. Cl.
*H04R 3/00* (2006.01)
*H04R 5/02* (2006.01)

(52) U.S. Cl.
CPC ..... *H04R 5/023* (2013.01)

(58) Field of Classification Search
CPC . H04R 2460/13; H04R 9/025; H04R 2400/03
USPC ..... 381/122, 370, 151, 61, 375, 412, 421
See application file for complete search history.

(56) References Cited

U.S. PATENT DOCUMENTS

| | | | | |
|---|---|---|---|---|
| 1,983,178 | A * | 12/1934 | Lybarger | 381/151 |
| 5,867,582 | A * | 2/1999 | Nagayoshi | 381/370 |
| 6,603,863 | B1 * | 8/2003 | Nagayoshi | 381/380 |
| 6,611,605 | B2 * | 8/2003 | Kim | 381/406 |
| 6,766,034 | B2 * | 7/2004 | Kobayashi et al. | 381/396 |
| 6,792,122 | B1 * | 9/2004 | Okada et al. | 381/151 |
| 8,077,898 | B2 * | 12/2011 | Huang | 381/345 |
| 2001/0017922 | A1 * | 8/2001 | Kim | 381/150 |
| 2003/0036364 | A1 * | 2/2003 | Chung | 455/90 |
| 2005/0180593 | A1 * | 8/2005 | Kajiwara et al. | 381/412 |
| 2006/0233418 | A1 * | 10/2006 | Huang | 381/417 |
| 2007/0206829 | A1 * | 9/2007 | Weinans et al. | 381/370 |
| 2009/0279729 | A1 * | 11/2009 | Huang | 381/345 |
| 2010/0239115 | A1 * | 9/2010 | Richardson | 381/384 |

* cited by examiner

*Primary Examiner* — Alexander Jamal
(74) *Attorney, Agent, or Firm* — Mintz Levin Cohn Ferris Glovsky and Popeo, P.C.

(57) ABSTRACT

Embodiments of apparatus and system for generating user detectable audio and mechanical vibration signals. Other embodiments may be described and claimed.

20 Claims, 6 Drawing Sheets

10

40

50

60

USER ADORNABLE APPARATUS AND SYSTEM FOR GENERATING USER DETECTABLE AUDIO AND MECHANICAL VIBRATION SIGNALS

CROSS REFERENCE TO RELATED APPLICATIONS

The present application claims priority to application Ser. No. 61/174,484, entitled "USER ADORNABLE APPARATUS AND SYSTEM FOR GENERATING USER DETECTABLE AUDIO AND VIBRATION SIGNALS", and filed on Apr. 30, 2009.

TECHNICAL FIELD

Various embodiments described herein relate to apparatus and system for generating user detectable audio and mechanical vibration signals.

BACKGROUND INFORMATION

It may be desirable to be able to generate user detectable audio signals and mechanical vibration signals in a user adornable apparatus or system. The present invention is such an apparatus and system.

DETAILED DESCRIPTION

Figure 1:
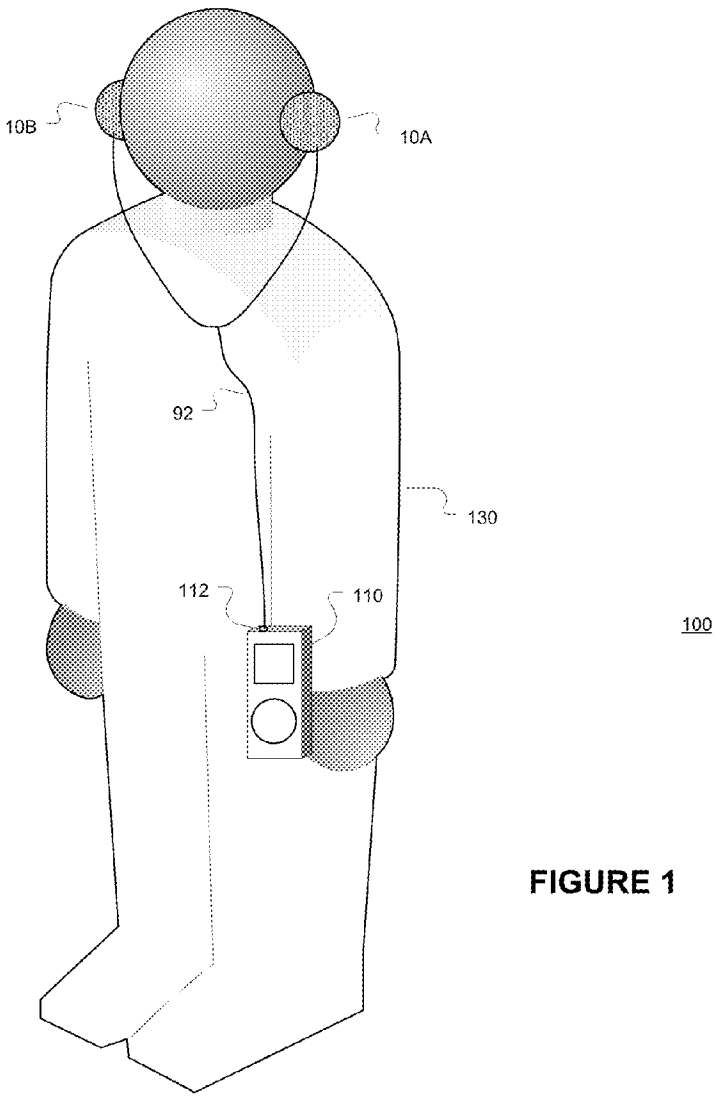
FIG. 1 is a block diagram of an audio and mechanical vibration signal generation architecture according to various embodiments.

FIG. 1 is a block diagram of an audio and mechanical vibration signal generation architecture 100 according to various embodiments. Architecture 100 includes a first audio and mechanical vibration signal generation apparatus 10A, a second audio and mechanical vibration signal generation apparatus 10B, an electrical signal generator 110, and a wire 92 coupling the electrical signal generator 110 to at least one of the apparatus 10A and 10B. One of the first audio and mechanical vibration signal generation apparatus 10A and the second audio and mechanical vibration signal generation apparatus 10B may be adorned by a user 130 including on a user's ear. In an embodiment, the first signal generation apparatus 10A may generate only audio signals and the second signal generation apparatus 10B may generate audio and mechanical vibration signals. In another embodiment, the first signal generation apparatus 10A may generate audio and mechanical vibration signals and the second signal generation apparatus 10B may generate only audio signals.

The electrical signal generator 110 may be any device capable of generating an electrical signal where the signal may represent an audio signal. In an embodiment the electrical signal generator 110 may be an audio generation device such a MPEG-1 Audio Layer 3 (MP3) player, personal data assistance (PDA), mobile phone, laptop, desktop computer, netbook, portable gaming device, and another electronic device capable of generating an electrical signal representing an audio waveform signal.

Figure 2A:
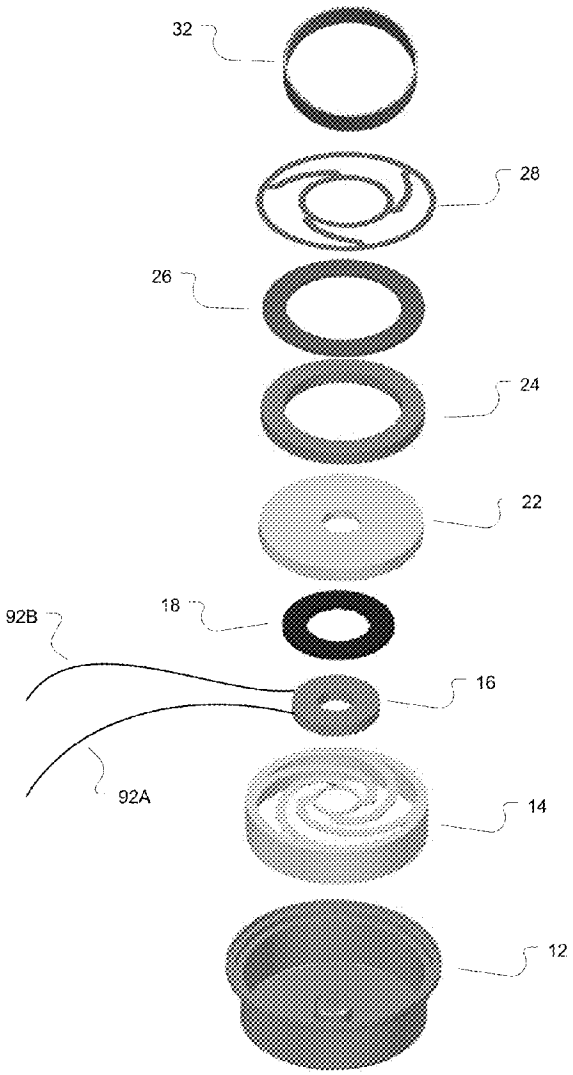
FIG. 2A is a block diagram of a combination audio and mechanical vibration signal generation apparatus according to various embodiments.

FIG. 2A is a block diagram of an audio waveform and mechanical vibration signal generation apparatus 10 according to various embodiments. The apparatus 10 includes a speaker frame 12, a speaker spring plate 14, a small magnet 16, a split washer 18, a washer 22, a large magnet 24, an outer split washer 26, a vibrating diaphragm 28, and a speaker loop 32. The small magnet 16 may be coupled to a first electrical wire 92B and a second electrical wire 92A. In an embodiment, the wires 92A, B may include a coupling interface 112 (FIG. 1) where the coupling interface may be a standard 2.5 or 3.5 mm jack or a proprietary connector such as a 30-pin Apple® connector or other such connector.

In an embodiment, electrical signals representing an audio signal having a wide frequency range such as from 20 Hz to 20 kHz applied to wire 92 may affect the small magnet 16 and corresponding vibrating diaphragm 28 to generate audio waveforms. Electrical signals representing an audio signal having a small, lower frequency range such as from 20 Hz to 200 Hz applied to wire 92 may affect the large magnet 24 and speaker spring plate 14, causing the larger magnet 24 to rock and produce user detectable mechanical vibration.

Further, an electrical signals representing an audio signal having wide frequency range such as from 20 Hz to 20 KHz applied to the wire 92 may affect the small magnet 16 and the large magnet 24. The small magnet 16 and the corresponding vibrating diaphragm 28 may generate audio waveforms representing the electrical signal frequency content. In addition, the larger magnet 24 may rock and produce user detectable mechanical vibration to represent the lower frequency content in the electrical signal.

It is noted that when an electrical signal representing an audio signal having a narrow low frequency content such as from 20 Hz to 20 KHz is applied to the wire 92, the signal may affect the small magnet 16 and the large magnet 24. Accordingly, the small magnet 16 and the corresponding vibrating diaphragm 28 may generate audio waveforms representing the electrical signal low frequency content. The larger magnet 24 may rock and produce user detectable mechanical vibration to represent the lower frequency content in the electrical signal. In the embodiment the speaker 10 simultaneously produces audio waveforms and mechanical vibrations when the applied signal includes low frequency content. The speaker 10 may enhance a user's experience by adding the mechanical vibration in addition to the audio waveform for low frequency content signals.

Accordingly, when an electrical signal including a low frequency component is applied to a speaker 10, 10A, 10B, the large magnet 24 may generate a user detectable mechanical vibration and the vibrating diaphragm 28 may generate a corresponding low frequency audio waveform. In particular, when an electrical signal via wire 92 or wires 92A, B is applied to the speaker 10, 10A, 10B and the frequency of the electrical signal is within the specified range, an interaction between a speaker loop (via magnet 16) and a magnetic field working with the speaker spring plate 14 may cause the large magnet 24 to rock and thus vibrate the speaker 10, 10A, 10B.

Figure 2B:
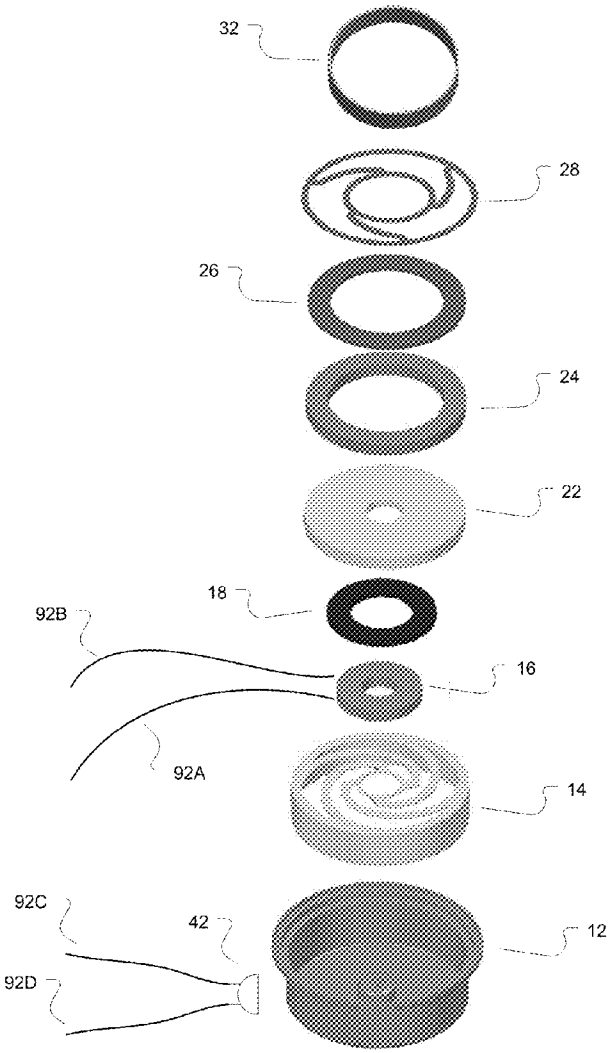
FIG. 2B is a block diagram of a combination audio and mechanical vibration signal generation apparatus according to various embodiments.

FIG. 2B is a block diagram of an audio and mechanical vibration signal generation apparatus 40 according to various embodiments. The speaker 40 is similar to speaker 10 but further includes a microphone 42 coupled to wires 92C, 92D. Speaker 40 may be used as a speaker 10A, 10B and further include a microphone 42 in one or both speakers 10A, 10B.

Figure 3:
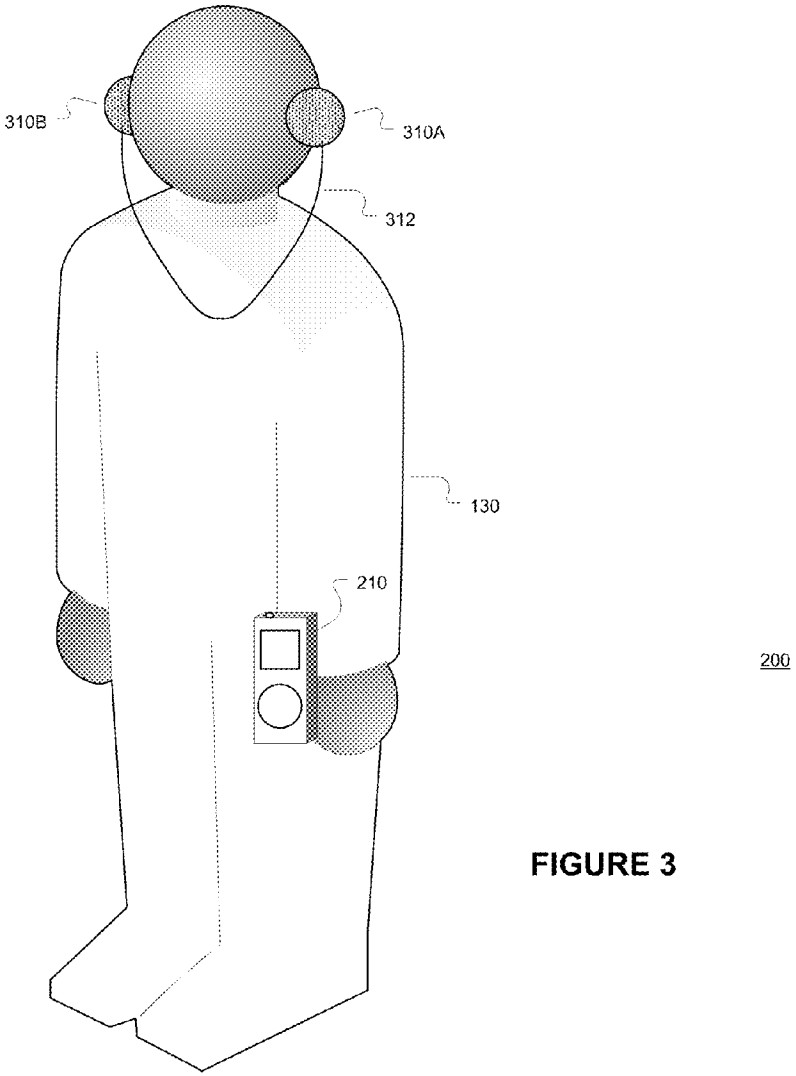
FIG. 3 is a block diagram of another audio and mechanical vibration signal generation architecture according to various embodiments.
Figure 4A:
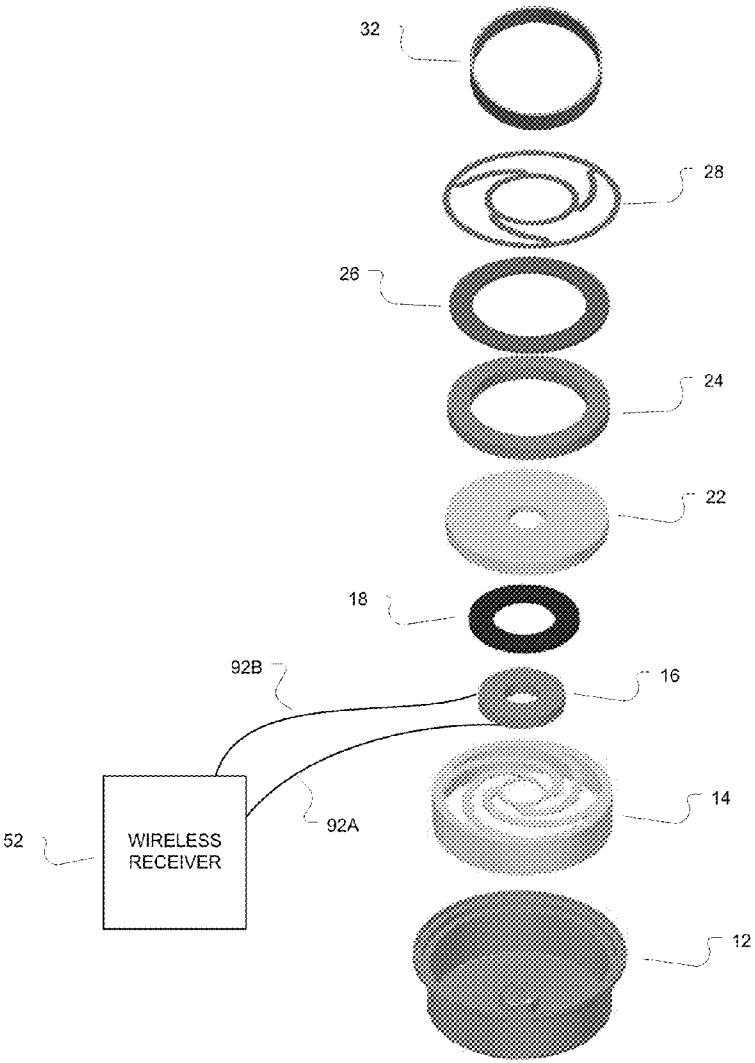
FIG. 4A is a block diagram of another combination audio and mechanical vibration signal generation apparatus according to various embodiments.
Figure 4B:
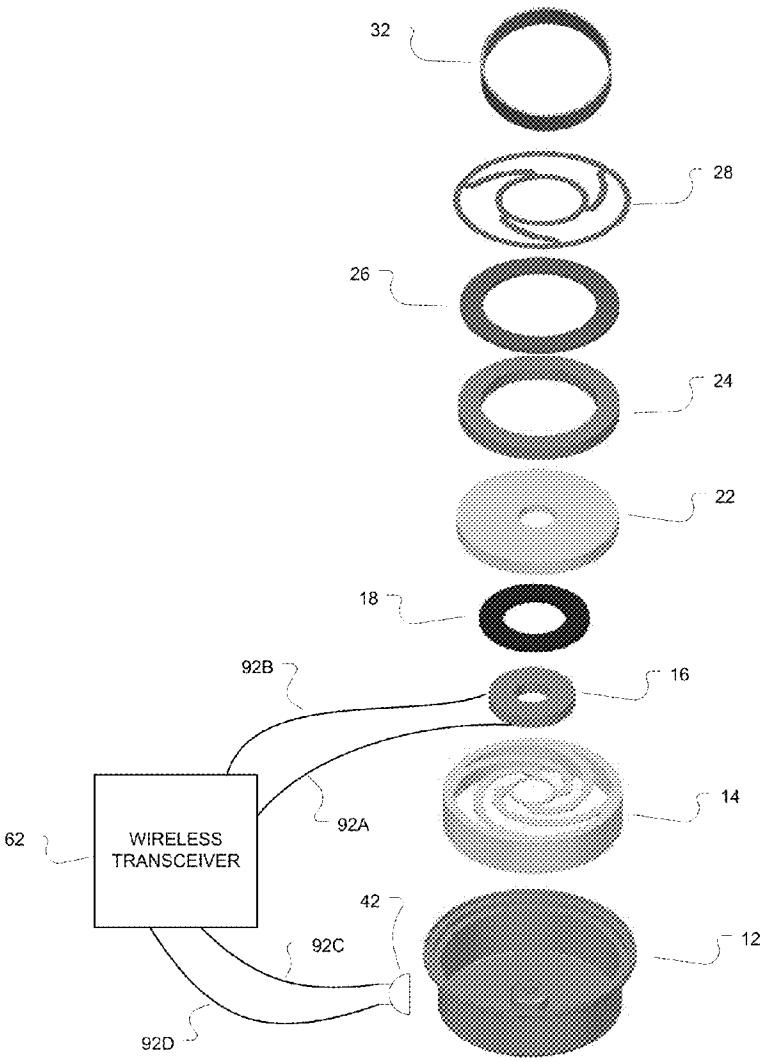
FIG. 4B is a block diagram of another combination audio and mechanical vibration signal generation apparatus according to various embodiments.

FIG. 3 is a block diagram of another audio and mechanical vibration signal generation architecture 200 according to various embodiments. FIG. 4A is a block diagram of an audio and mechanical vibration signal generation apparatus 50 according to various embodiments. FIG. 4B is a block diagram of an audio and mechanical vibration signal generation apparatus 60 according to various embodiments. Architecture 200 may employ wireless signals to communicate an audio signal from an electronic device 210 to a speaker 310A, 310B, 50, 60. The electronic device 210 may wirelessly communicate audio signals via a known format such as Bluetooth formats, IEEE 802.1 formats, mesh formats, WiFi formats, and WiMax formats.

In FIG. 4A the speaker 50 (representing 310A or 310B) may include a wireless receiver 52 to receive electrical signals representing audio signals. The wireless receiver 52 may also generate an electrical signal on wires 92A, 92B based on a received wireless signal. As shown in FIG. 4B a speaker 60 (representing 310A or 310B) may include a wireless transceiver 62 that may receive electrical signals representing audio signals from a device 210 and transmit electrical signals representing an audio signal detected by microphone 42 to a device 210. In particular, a wireless transceiver 62 may generate an electrical signal on wires 92A, 92B based on a received wireless signal. The transceiver 62 may also receive an electrical signal from the microphone 42 via wires 92C, 92D. The transceiver 62 may convert the received microphone 42 signals to a wireless signal and transmit the signal to an electronic device 210. A speaker 310A or 310B may include a receiver 52 or transceiver 62. A speaker 310A or 310B may then communicate an electrical signal via a wire 312 to the other of the speaker 310A and 310B in an embodiment.

Any of the components previously described may be implemented in a number of ways, including embodiments in software. Any of the components previously described can be implemented in a number of ways, including embodiments in software. Thus, the speaker 10, 10A, 10B, 40, 50, 42, 52, 62 may all be characterized as "modules" herein.

The modules may include hardware circuitry, single or multi-processor circuits, memory circuits, software program modules and objects, firmware, and combinations thereof, as desired by the architect of the architecture 10 and as appropriate for particular implementations of various embodiments. The apparatus and systems of various embodiments may be useful in applications other than a sales architecture configuration. They are not intended to serve as a complete description of all the elements and features of apparatus and systems that might make use of the structures described herein.

Applications that may include the novel apparatus and systems of various embodiments include electronic circuitry used in high-speed computers, communication and signal processing circuitry, modems, single or multi-processor modules, single or multiple embedded processors, data switches, and application-specific modules, including multilayer, multi-chip modules. Such apparatus and systems may further be included as sub-components within a variety of electronic systems, such as televisions, cellular telephones, personal computers (e.g., laptop computers, desktop computers, handheld computers, tablet computers, etc.), workstations, radios, video players, audio players (e.g., mp3 players), vehicles, medical devices (e.g., heart monitor, blood pressure monitor, etc.) and others. Some embodiments may include a number of methods.

It may be possible to execute the activities described herein in an order other than the order described. Various activities described with respect to the methods identified herein can be executed in repetitive, serial, or parallel fashion. A software program may be launched from a computer-readable medium in a computer-based system to execute functions defined in the software program. Various programming languages may be employed to create software programs designed to implement and perform the methods disclosed herein. The programs may be structured in an object-orientated format using an object-oriented language such as Java or C++. Alternatively, the programs may be structured in a procedure-orientated format using a procedural language, such as assembly or C. The software components may communicate using a number of mechanisms well known to those skilled in the art, such as application program interfaces or inter-process communication techniques, including remote procedure calls. The teachings of various embodiments are not limited to any particular programming language or environment.

The accompanying drawings that form a part hereof show, by way of illustration and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In the foregoing Detailed Description, various features are grouped together in a single embodiment for the purpose of streamlining the disclosure. This method of disclosure is not to be interpreted to require more features than are expressly recited in each claim. Rather, inventive subject matter may be found in less than all features of a single disclosed embodiment. Thus, the following claims are hereby incorporated into the Detailed Description, with each claim standing on its own as a separate embodiment.

What is claimed is:

1. An audio waveform and mechanical vibration generation apparatus, including:

a wire pair capable of receiving an electrical signal having a frequency range;

a speaker module coupled to the wire pair, the speaker module including a housing with a single continuous cavity encasing:

an audio waveform generation module (AWGM) comprising a speaker spring plate and an AWGM magnet, the speaker springy plate and the AWGM magnet configured to facilitate the generation of an audio waveform from a received electrical signal, the audio waveform having a frequency range from a first predetermined frequency to a second, higher, predetermined frequency; and a mechanical vibration generation module (MVGM) comprising a first MVGM magnet configured to rock, in response to receipt of the electrical signal, to create a mechanical vibration, the MVGM configured to facilitate generating the mechanical vibration, from the received electrical signal, simultaneously with the generation of the audio waveform by the AWGM.

2. The audio waveform and mechanical vibration generation apparatus of claim 1, wherein the MVGM generates a mechanical vibration when the received signal has a frequency range from a third predetermined frequency to a fourth, higher predetermined frequency.

3. The audio waveform and mechanical vibration generation apparatus of claim 2, wherein the generated audio waveform frequency range and the mechanical vibration module frequency range at least partially overlap.

4. The audio waveform and mechanical vibration generation apparatus of claim 2, wherein the MVGM includes a spring plate adjacent a first magnet.

5. The audio waveform and mechanical vibration generation apparatus of claim 4, wherein the AWGM includes a diaphragm adjacent the first MVGM magnet and the second MVGM magnet is located between the first MVGM magnet and the spring plate along a central axis of the diaphragm and the first MVGM magnet.

6. The audio waveform and mechanical vibration generation apparatus of claim 5, wherein the single continuous cavity is substantially cylindrical and has a central axis that is aligned with the central axis of the diaphragm and the first MVGM magnet.

7. The audio waveform and mechanical vibration generation apparatus of claim 4, further including a wireless receiver, the wireless receiver coupled to the wire pair and capable of receiving a wireless signal and generating a corresponding electrical signal on the wire pair.

8. The audio waveform and mechanical vibration generation apparatus of claim 4, further including a microphone.

9. The audio waveform and mechanical vibration generation apparatus of claim 8, further including a wireless transceiver, the wireless transceiver coupled to the wire pair and to the microphone and capable of receiving a wireless signal and generating a corresponding electrical signal on the wire pair and transmitting a wireless signal corresponding to an electrical signal generated by the microphone.

10. The audio waveform and mechanical vibration generation apparatus of claim 4, including a first speaker module and a second speaker module the first and the second speaker modules configured to be worn on a user's left and right ears and only one of the first and the second speaker module including a MVGM.

11. An audio waveform and mechanical vibration generation apparatus, the apparatus capable of receiving an electrical signal including a plurality of frequencies, including:

a speaker module, including a housing with a single continuous cavity encasing:

an audio waveform generation module (AWGM) comprising a speaker spring plate and an AWGM magnet, the speaker and the AWGM magnet configured to facilitate the generation of an audio waveform from a received electrical signal, the audio waveform having a frequency range from a first predetermined frequency to a second, higher predetermined frequency from a received electrical signal; and a mechanical vibration generation module capable (MVGM) comprising a first MVGM magnet configured to rock, in response to receipt of the electrical signal, to create a mechanical vibration, the MVGM configured to facilitate generating the mechanical vibration, from the received electrical signal, simultaneously with the generation of the audio waveform by the AWGM.

12. The audio waveform and mechanical vibration generation apparatus of claim 11, wherein first MVGM magnet generates a mechanical vibration when the received signal has a frequency range from a third predetermined frequency to a fourth, higher predetermined frequency.

13. The audio waveform and mechanical vibration generation apparatus of claim 12, wherein the generated audio waveform frequency range and the mechanical vibration module frequency range at least partially overlap.

14. The audio waveform and mechanical vibration generation apparatus of claim 12, wherein the MVGM includes a spring plate adjacent a second MVGM magnet.

15. The audio waveform and mechanical vibration generation apparatus of claim 14, wherein the AWGM includes a diaphragm adjacent the first MVGM magnet and the second MVGM magnet is located between the first MVGM magnet and the spring plate along a central axis of the diaphragm and the first MVGM magnet.

16. The audio waveform and mechanical vibration generation apparatus of claim 15, wherein the single continuous cavity is substantially cylindrical and has a central axis that is aligned with the central axis of the diaphragm and the first MVGM magnet.

17. The audio waveform and mechanical vibration generation apparatus of claim 15, further including a microphone and a wireless transceiver, the wireless transceiver coupled to the microphone, the AWGM, and the MVGM and capable of receiving a wireless signal and generating a corresponding electrical signal on the wire pair and transmitting a wireless signal corresponding to an electrical signal generated by the microphone.

18. A method of generating an audio waveform and mechanical vibration in a single apparatus based on a received electrical signal including a plurality of frequencies, the method including:

generating, by a speaker module, an audio waveform from a received electrical signal having a frequency range from a first predetermined frequency to a second, higher predetermined frequency from the received electrical signal; and, generating, by a speaker module, a mechanical vibration from the received electrical signal, the speaker module including a housing with a single continuous cavity encasing:

an audio waveform generation module (AWGM) comprising a speaker spring plate and an AWGM magnet, the speaker spring plate and the AWGM magnet configured to facilitate the generation of the audio waveform from a received electrical signal; and a mechanical vibration generation module (MVGM) comprising a first MVGM magnet configured to rock in response to receipt of the electrical signal to create the mechanical vibration.

19. The method of generating an audio waveform and mechanical vibration in a single apparatus based on a received electrical signal of claim 18, wherein MVGM first magnet generates a mechanical vibration when the received signal has a frequency range from a third predetermined frequency to a fourth, higher predetermined frequency.

20. The method of generating an audio waveform and mechanical vibration in a single apparatus based on a received electrical signal of claim 18, wherein the generated audio waveform frequency range and the mechanical vibration module frequency range at least partially overlap and the MVGM includes a spring plate adjacent a second MVGM magnet.

* * * * *